US005618612A

United States Patent [19]

Gstrein

[11] Patent Number: 5,618,612

[45] Date of Patent: Apr. 8, 1997

[54] PRESS FELT HAVING FINE BASE FABRIC

[75] Inventor: Hippolit Gstrein, Gloggnitz, Austria

[73] Assignee: Huyck Licensco, Inc., Wilmington, Del.

[21] Appl. No.: 453,635

[22] Filed: May 30, 1995

[51] Int. Cl.[6] ..... D03D 3/00

[52] U.S. Cl. ..... 442/189; 139/383 A; 162/358.1; 442/205; 442/247

[58] Field of Search ..... 428/116, 225, 428/229, 234, 257, 300, 258, 246, 252; 162/348, DIG. 1, 358.1; 139/383 A

[56] References Cited

U.S. PATENT DOCUMENTS

| | | | |
|---|---|---|---|
| 4,105,495 | 8/1978 | Pai | 162/348 |
| 4,323,622 | 4/1982 | Gladh et al. | 428/230 |
| 4,503,113 | 3/1985 | Smart | 428/234 |
| 4,632,716 | 12/1986 | Smith | 156/148 |
| 4,839,220 | 6/1989 | Stijntjes et al. | 428/258 |
| 5,368,696 | 11/1994 | Cunnane et al. | 162/358.2 |

*Primary Examiner*—James J. Bell
*Attorney, Agent, or Firm*—Lorusso & Loud

[57] ABSTRACT

A base fabric structure and a press felt incorporating that base fabric structure, having at least one set of plied monofilament twist yarns in the cross machine direction. The base fabric structure may be a single base fabric, or it may be a base fabric assembly of more than one separately woven fabric layers, of which one, more than one, or all will have plied monofilament twist yarns in the cross machine direction.

25 Claims, 2 Drawing Sheets

PRESS FELT HAVING FINE BASE FABRIC

BACKGROUND OF THE INVENTION

This invention relates to papermakers' fabrics and especially to papermaking felts for the press section of a papermaking machine.

In the conventional fourdrinier papermaking process, a water slurry or suspension of cellulose fibers, known as the paper "stock", is fed onto the top of the upper run of a traveling endless forming belt. The forming belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the drainage side of the fabric.

After leaving the forming medium the somewhat self-supporting paper web is transferred to the press section of the machine and onto a press felt, where still more of its water content is removed by passing it through a series of pressure nips formed by cooperating press rolls, these press rolls serving to compact the web as well. A press felt, generally, is produced from one or more base fabrics to which is added one or more layers of batt material.

Subsequently, the paper web is transferred to a dryer section where it is passed about and held in heat transfer relation with a series of heated, generally cylindrical rolls to remove still further amounts of water therefrom.

In general, the press felts in the press section are used in papermaking machinery to support the moist, freshly formed paper web as it encounters a variety of rolls to extract water from the moist paper web. In addition to serving as a support for the moist paper web, the press felt serves as a receptacle for the water removed from the paper sheet. Preferably, the press felts are woven so as to have relatively large open areas or voids which will enhance their water-conveying capabilities. The press felt normally has a conveyer belt-like shape and during the various operations previously mentioned, a large amount of water is built up in the press felt which is removed by suction or various other drainage devices, usually after the paper web and press felt are no longer in direct contact.

In the press section of the machine, it is advantageous to remove as much water as possible from the paper web without causing any damage thereto, such as by crushing. Crushing occurs when an excessive amount of water is removed from the paper web, the excessive water than accumulating at the ingoing side of the nip, not carrying through the nip, and moving in a direction counter to that of the moving paper web. Accordingly, care should be taken to ensure that there is sufficient void volume present in the area of the press nip (either in the papermaking fabric or in the press rolls) such that as the paper web undergoes compaction and compression, all of the water expressed therefrom will be carried through the nip.

A press felt's performance with respect to drainage is affected by its contact area and caliper. The contact area represents the area of the felt that is in contact with the paper sheet in the microscale. In areas of contact between the press felt and paper sheet, mechanical pressure is higher, giving better drainage compared to areas without pressure. The higher the contact area becomes, the better the drainage, as long as the press felt provides enough permeability.

Additionally, caliper affects drainage in that reducing the caliper of a fabric means shorter flow channels in the felt. Shorter flow channels will make dewatering performance more efficient.

It is also important that the press felt provide a good papermaking surface. Standard in the industry today for production of a base fabric for a press felt is the use of cross machine direction yarns of coarse monofilament twists, for example polyamide (PA) 0.2×2×2 or PA 0.2×2×3 or single monofilaments, such as PA 0.2 to PA 0.5. It has been found that coarse monofilament twists do not form round shaped, uniform twists. Accordingly, at the crossings of machine direction yarns and cross machine direction yarns in the fabric, hard knuckles are formed. These knuckles are responsible for nonuniform pressure transfer in the microscale between the felt and the paper sheet. Surface marking and shadow marks are caused by the nonuniform specific pressure in the press nip.

On the other hand, it has been determined that single monofilaments are not suitable for use because they do not have flexibility. There are significant limitations on the single monofilament's ability to adopt to demanding press positions where resiliency is required.

Therefore, one object of the present invention is to provide an improved papermakers' felt for use in the press section of the papermaking machine.

Another object of the present invention is to provide an improved papermakers' felt having increased contact area and improved resiliency.

Another object of the present invention is to provide an improved dewatering arrangement in the press section of a papermaking machine wherein relatively large quantities of water may be removed from a paper web without crushing or marking the surface thereof by offering shorter flow channels and low flow resistances.

A further object of the present invention is to provide means for increasing the amount of water removed from a paper web in the press section of a papermaking machine.

Still another object of the present invention is to provide an improved papermaking press felt with improved water flow and compaction resistance.

SUMMARY OF THE INVENTION

The present invention is a base fabric for press felts, and a press felt incorporating that base fabric, in which the base fabric is produced with fine plied monofilament twist yarns in the cross machine direction. The base fabric incorporating the fine plied monofilament twist yarns in the cross machine direction may be produced in any weave pattern suitable for a base fabric. In another embodiment, the base fabric may be a laminated base fabric assembly, including two or more fabric layers, in which one or more of the fabric layers includes cross machine direction yarns that are fine plied monofilament twists.

Additional objects and advantages of this invention, together with a better understanding thereof, may be had by referring to the following detailed description together with the accompanying drawing.

DETAILED DESCRIPTION OF THE INVENTION

Figure 1:
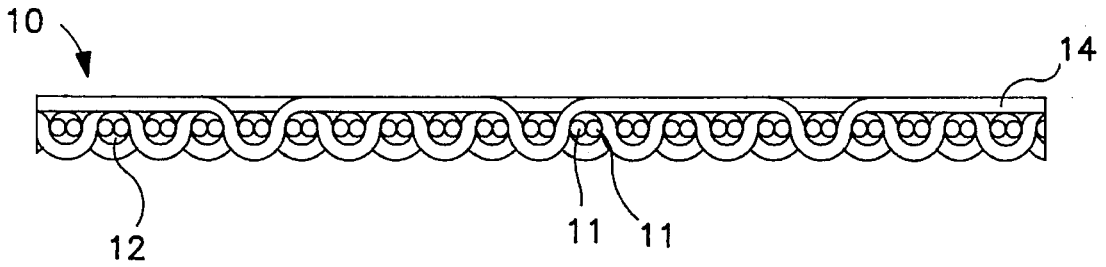
FIG. 1 illustrates in cross section one embodiment of a base fabric according to the present invention.

The present invention will be described broadly, with a more detailed description following. Described herein is a base fabric for a press felt, and a press felt incorporating that base fabric for use in the press section of a papermaking machine, that base fabric including plied monofilament twist yarns in the cross machine direction. The base fabric may be a single base fabric or a base fabric assembly comprised of more than one separately woven fabric layers, of which one, more than one, or all will have plied monofilament twist yarns in the cross machine direction.

The weave of the base fabric, or of the individual fabric layers in the embodiment including a base fabric assembly, may be any weave suitable for a base fabric for a press felt. The preferred weave for a base fabric according to the present invention will depend on the application of the finished press felt. It is envisioned that single layer, double layer and triple layer weaves can be used in a base fabric according to the present invention. One skilled in the relative art will easily be able to choose a weave depending on the application of the finished press felt within the concepts of the present invention. For example, to maximize the papermaking surface, weaves with long floats may be used near the papermaking surface of the press felt to improve surface uniformity. One such preferred weave is a 6 harness satin weave that can be used in the present invention. A weave with short floats, like a broken twill, can be incorporated into a base fabric of the present invention to improve compaction resistance, and is especially preferred for fabric layers that will contact the papermaking machinery.

When a press fabric according to the present invention includes a base fabric assembly, in a preferred embodiment, the individual fabric layers of the base fabric assembly will be single layer weaves. Again, the selection of the individual fabric layers in a base fabric assembly according to the present invention dependent on the application of the finished press felt is within the skill of those knowledgeable in the relevant art. Base fabric stratification will be planned according to the demands in uniform pressure transfer, void volume and compaction resistance.

Yarns selected for use in each of the fabric layers of the base fabric of the press felt of the present invention may be those commonly used in press felt base fabric layers. For example, the yarns could be cotton, wool, polypropylenes, polyesters, aramides or polyamides. Again, one skilled in the relevant art will select a yarn material according to the particular application of the final composite press felt.

The yarns utilized in the base fabric assembly or base fabric of the present invention will vary depending upon the desired properties of the final composite press felt. In accordance with the concepts of the present invention, at least one set of the cross machine direction yarns in the base fabric or in one base fabric of the base fabric assembly will be plied monofilament twists. As is well known to those skilled in the art, a plied yarn is one in which two or more single yarns are twisted together. The plied monofilament of the present invention will be more than one monofilament yarn turned to a single twist.

The plied monofilament twist yarns utilized in the cross machine direction for the base fabric according to the present invention will preferably have a single monofilament diameter ranging from approximately 0.1 mm to approximately 0.3 mm. The most preferred plied monofilament twist yarns for use in the cross machine direction of a base fabric according to the present invention are polyamide monofilament twists. The preferred polyamide monofilament twists are PA monofilament yarns, generally 0.1 mm or 0.2 mm in diameter, used two ply or three ply.

The remaining yarns in the base fabric may be multifilament yarns, monofilament yarns, twisted multifilament and/or monofilament yarns, spun yarns or any combination of the above. It is within the skill of those practicing in the relevant art to select a yarn type, depending on the purpose of the desired press felt, to utilize with the concepts of the present invention.

To form a press felt incorporating the base fabric of the present invention, one or more batt layers will be positioned on the base fabric or assembled fabric layers and subsequently needled thereto. Of course, a layer of batt material will be positioned on the side of the to-be-formed press felt that will contact the paper web. Additionally, one or more layers of batt material may be inserted on the machine-contacting surface of the to-be-formed press felt. The batt material is made up of fibers formed from any of the well known natural or synthetic fibers which are commonly used for this purpose, including such animal fibers as wool and such synthetic fibers as polyacrylics, such as Orlon, polyesters such as Dacron, and polyamide such as Nylon. They are needled to the assembled fabric layers in a conventional manner. In the needling process, the assembled fabric layers are joined together as well.

The invention will be described with reference to the embodiments shown in the figures, which embodiments should be considered as illustrative, but not limiting.

FIG. 1 illustrates one embodiment of a base fabric 10 according to the present invention. The base fabric 10 is a single layer weave of interwoven cross machine direction yarns 12 and machine direction yarns 14 having long floats on the papermaking surface of the base fabric. In the cross machine direction, two monofilaments 11 of polyamide 0.2 are used, twisted together to produce each cross machine direction plied monofilament twist yarn 12.

Figure 2:
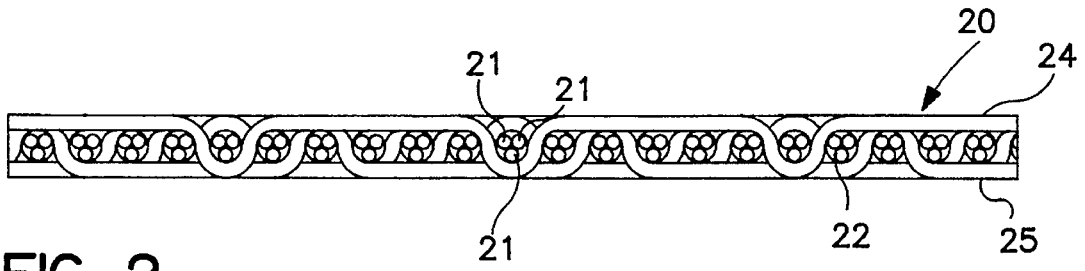
FIG. 2 illustrates in cross section another embodiment of a base fabric according to the present invention.

FIG. 2 illustrates another embodiment of a base fabric 20 according to the present invention. Base fabric 20 is a dual layer weave, by which is meant a fabric having two sets of machine direction yarns 24, 25 with one set of cross machine direction yarns 22 interweaving them. The cross machine direction yarns 22 are produced from three twisted monofilaments of polyamide 0.2, 21, the three monofilaments 21 twisted together to produce the cross machine direction plied monofilament twist yarns 22.

Figure 3:
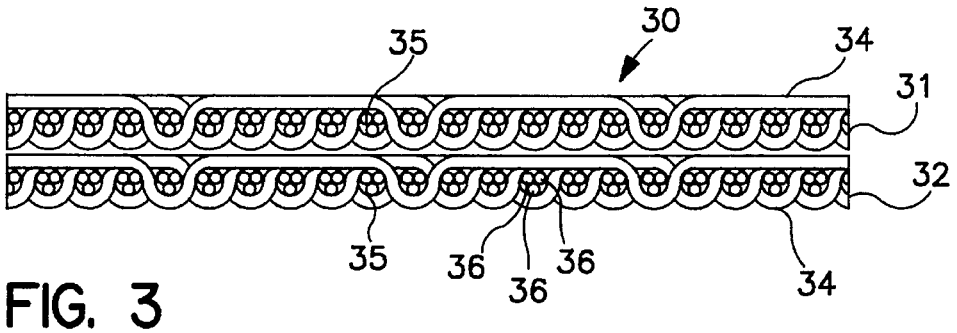
FIG. 3 illustrates in cross section a preferred embodiment of a base fabric according to the present invention.

FIG. 3 illustrates a preferred embodiment of the base fabric of the present invention in which the base fabric 30 is an assembly of two fabric layers, 31 and 32. Each fabric layer 31, 32 in this embodiment is a single layer weave and is made of interwoven cross machine direction yarns 35 and machine direction yarns 34. In each fabric layer 31, 32, the cross machine direction plied monofilament twist yarns 35 are made from three individual monofilaments 36 twisted together.

Figure 4:
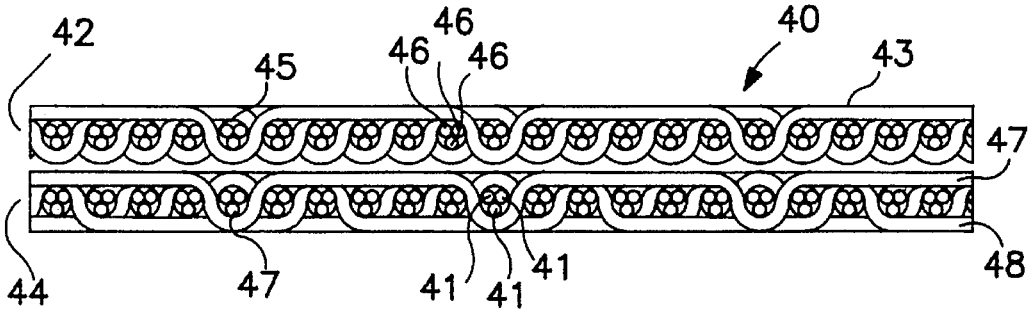
FIG. 4 illustrates in cross section yet another embodiment of a base fabric according to the present invention.

A base fabric 40 produced from a base fabric assembly of two fabric layers 42, 44 is shown in FIG. 4 as well. In this embodiment, however, fabric layer 44 is a dual layer weave having two sets of machine direction yarns 47 and 48 while fabric layer 42 is a single layer weave incorporating machine direction yarns 43. In both fabric layers 42, 44, cross machine direction plied monofilament twist yarns 45, 47 are three individual monofilaments 46, 41 twisted together.

Figure 5:
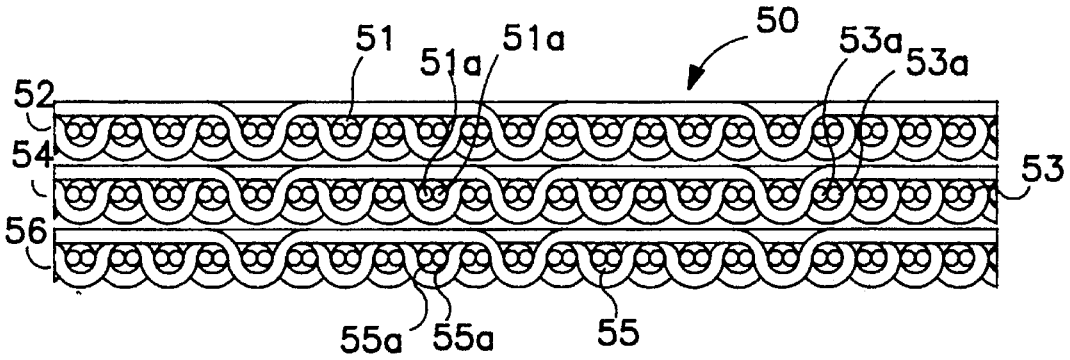
FIG. 5 illustrates in cross section still another preferred embodiment of a base fabric according to the present invention.

In FIG. 5, the base fabric 50 is an assembly of three fabric layers 52, 54, 56, each a single layer weave. In each fabric layer, the cross machine direction plied monofilament twist yarns 51, 53, 55 are two individual monofilaments 51*a*, 53*a*, 55*a* twisted together.

Figure 6:
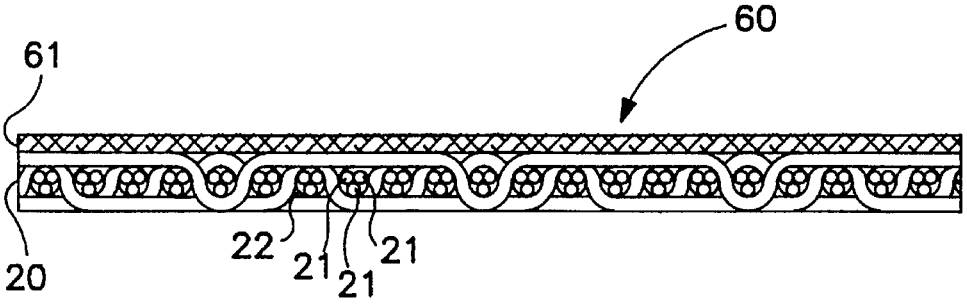
FIG. 6 illustrates in cross section a press felt according to the present invention, including the base fabric shown in FIG. 2.

Finally, FIG. 6 illustrates a press felt 60 produced according to the concepts of the present invention. A base fabric 20 as shown in FIG. 2 is assembled with a layer of batt material 61 on its papermaking surface and the assembled structure is needled together in one or more needling operations.

It is within the knowledge of one skilled in the art to select the number of and weaves for the fabric layers to be included in a press felt according to concepts of the present invention. An advantage to the press felt described herein is that the different yarn systems facing each other provide more equal pressure support in the press nip. In addition, a better balancing of water flow and compaction resistance is achieved because the fabrics adapt to pressure transfer and porosity more easily. The application of the concept of multiple base fabric layers offers the possibility to select fabric layers to optimize the performance characteristics for the different requirements needed of the felt produced. To ensure a uniform pressure transfer, high water-permeability and good compaction resistance, for example, a dense machine direction oriented top fabric layer with long machine direction floats will be chosen. In addition, a coarser cross machine direction oriented bottom fabric layer will ensure good abrasion resistance and wear resistance of the felt. Moreover, the fact that there can be at least two fabric layers ensures a good compaction resistance and increases the permeability of the felt. The use of long machine direction or cross machine direction floats on the top surface of the intermediate and bottom layers provides support and maintains the individual desired characteristics of the separate fabric layers.

While a preferred embodiment of the invention has been described and illustrated, it will be understood that modifications may be made in the invention without departing from its spirit and purpose.

What is claimed is:

1. A base fabric structure for a press felt for a papermaking machine comprising:

at least one base fabric, said at least one base fabric produced from at least one set of machine direction yarns interwoven with at least one set of cross machine direction yarns, wherein each cross machine direction yarn of at least one set of said at least one set of cross machine direction yarns is a single, plied yarn of at least two twisted monofilaments.

2. The base fabric structure of claim 1 wherein the twisted monofilaments comprise two monofilaments twisted together.

3. The base fabric structure of claim 1 wherein the twisted monofilaments comprises three monofilaments twisted together.

4. The base fabric structure of claim 1 wherein the at least one base fabric comprises one base fabric and the base fabric is a single layer weave.

5. The base fabric structure of claim 1 wherein the at least one base fabric comprises one base fabric and the base is a dual layer weave.

6. The base fabric structure of claim 1 wherein the at least one base fabric comprises an assembly of two base fabric layers.

7. The base fabric structure of claim 6 wherein the cross machine direction yarns in each of the two base fabric layers comprises twisted monofilaments.

8. The base fabric structure of claim 7 wherein the twisted monofilaments are three monofilaments twisted together.

9. The base fabric structure of claim 6 wherein the two base fabric layers comprise a single layer weave positioned above and adjacent to a dual layer weave.

10. The base fabric structure of claim 6 wherein the two base fabric layers each comprise a single layer weave.

11. The base fabric structure of claim 1 wherein the at least one base fabric comprises an assembly of three fabric layers and each of the three fabric layers is a single layer weave.

12. A press felt for a papermaking machine comprising:

at least one base fabric, said at least one base fabric produced from at least one set of machine direction yarns interwoven with at least one set of cross machine direction yarns, wherein each cross machine direction yarn of at least one set of said at least one set of cross machine direction yarns is a single, plied yarn of at least two twisted monofilaments;

at least one layer of batt material positioned adjacent to said at least one base fabric needled thereto.

13. The press felt of claim 12 wherein in the at least one base fabric, the twisted monofilaments comprise two monofilaments twisted together.

14. The press felt of claim 12 wherein the twisted monofilaments comprise three monofilaments twisted together.

15. The press felt of claim 12 wherein the at least one base fabric comprises one base fabric and the base fabric is a single layer weave.

16. The press felt of claim 12 wherein the at least one base fabric comprises one base fabric and the base is a dual layer weave.

17. The press felt of claim 12 wherein the at least one base fabric comprises an assembly of two base fabric layers.

18. The press felt of claim 17 wherein the cross machine direction yarns in each of the two base fabric layers comprise twisted monofilaments.

19. The press felt of claim 18 wherein the twisted monofilaments comprise two monofilaments twisted together.

20. The press felt of claim 18 wherein the twisted monofilaments comprise three monofilaments twisted together.

21. The press felt of claim 17 wherein the two base fabric layers comprise a single layer weave positioned above and adjacent to a dual layer weave.

22. The press felt of claim 17 wherein the two base fabric layers each comprise a single layer weave.

23. The press felt of claim 12 wherein the at least one base fabric comprises an assembly of three fabric layers and each of the three fabric layers is a single layer weave.

24. The press felt of claim 23 wherein the cross machine direction yarns in each of the three base fabric layers comprise twisted monofilaments.

25. The press felt of claim 24 wherein the twisted monofilaments comprise three monofilaments twisted together.

* * * * *